US005956561A

United States Patent [19]

Bugle et al.

[11] Patent Number: 5,956,561

[45] Date of Patent: Sep. 21, 1999

[54] NET SHAPED DIES AND MOLDS AND METHOD FOR PRODUCING THE SAME

[75] Inventors: Clifford M. Bugle; Carl A. Lombard, both of Library, Pa.

[73] Assignee: Dynamet Incorporated, Washington, Pa.

[21] Appl. No.: 08/983,149

[22] PCT Filed: Apr. 15, 1997

[86] PCT No.: PCT/US97/06334

§ 371 Date: Jan. 14, 1998

§ 102(e) Date: Jan. 14, 1998

[87] PCT Pub. No.: WO97/40777

PCT Pub. Date: Nov. 6, 1997

Related U.S. Application Data

[60] Provisional application No. 60/015,979, Apr. 15, 1996.

[51] Int. Cl.[6] ..... B22F 3/14

[52] U.S. Cl. ..... 419/49; 419/26; 75/228; 75/246; 75/247; 29/DIG. 31

[58] Field of Search ..... 419/49, 26; 75/228, 75/246, 247; 29/DIG. 31

[56] References Cited

U.S. PATENT DOCUMENTS

| | | | |
|---|---|---|---|
| Re. 31,355 | 8/1983 | Rozmus | 419/49 |
| 4,233,720 | 11/1980 | Rozmus | 29/407 |
| 4,492,737 | 1/1985 | Conolly | 428/552 |
| 5,308,556 | 5/1994 | Bagley | 264/13 |
| 5,435,824 | 7/1995 | Dorsch et al. | 75/231 |

FOREIGN PATENT DOCUMENTS 1399669 2/1975 United Kingdom .

*Primary Examiner*—Daniel J. Jenkins

*Attorney, Agent, or Firm*—Webb Ziesenheim Bruening Logsdon Orkin & Hanson, P.C.

[57] ABSTRACT

A method for making dies or molds from powdered metals is disclosed. The method includes the steps of: providing a pattern of a desired shape to define the mold or die cavity configuration; providing a canister; placing the pattern in the canister and filling the canister with a selected powdered metal; hot isostatic pressing the canister and powdered metal to produce a consolidated and densified compact; and sectioning the compact along a plane to enable removal of the pattern and thus providing the desired die or mold cavity in the fully densified powdered metal die or mold set so formed.

13 Claims, 3 Drawing Sheets

NET SHAPED DIES AND MOLDS AND METHOD FOR PRODUCING THE SAME

This application is a 371 filed Apr. 15, 1997. This application claim benefits of provisional application 60/015,979 filed Apr. 15, 1996.

BACKGROUND OF THE INVENTION

The present invention relates to the production of dies and molds made directly from powdered metals. The dies, according to the invention, are made by placing a specially formed pattern, having the shape of the desired die cavity, into a canister and fixing it in an appropriate location inside of the canister. The spaces between the pattern and the canister are then filled with a selected powdered metal, evacuated and sealed. Hot Isostatic Pressing (HIP) is then used to consolidate the powdered metal to full density. Separation of the compact along an appropriate plane enables the pattern to be removed thereby revealing the desired die cavity formed in the consolidated powdered metal.

Present techniques for the production of dies involve casting ingots of the die material which must be reduced in size by rolling and/or forging. These steps result in significant yield loss of the material and create less than ideal mechanical properties due to the coarse nature of the microstructure. Following the rolling or forging, it is necessary to machine the cavity into the die. This is a very time consuming and labor intensive process which results in substantial expense and in additional wasted material.

SUMMARY OF THE INVENTION

The present invention is directed to a method of making dies and molds for subsequent use in the manufacture of shaped parts, such as by die casting, injection molding and the like. The method includes the steps of providing a pattern of a desired shape to define the finished mold or die cavity configuration; placing the pattern in a canister; filling the interior of the canister with a selected powdered metal to surround the pattern therein; hot isostatic pressing the canister and powdered metal by the application of heat and pressure to consolidate and densify the powdered metal surrounding the pattern; and sectioning the canister and densified metal along a plane to remove the pattern and thus provide a die or mold cavity of desired shape in the densified metal sections.

DETAILED DESCRIPTION OF THE PREFERRED EMBODIMENT

Figure 1:
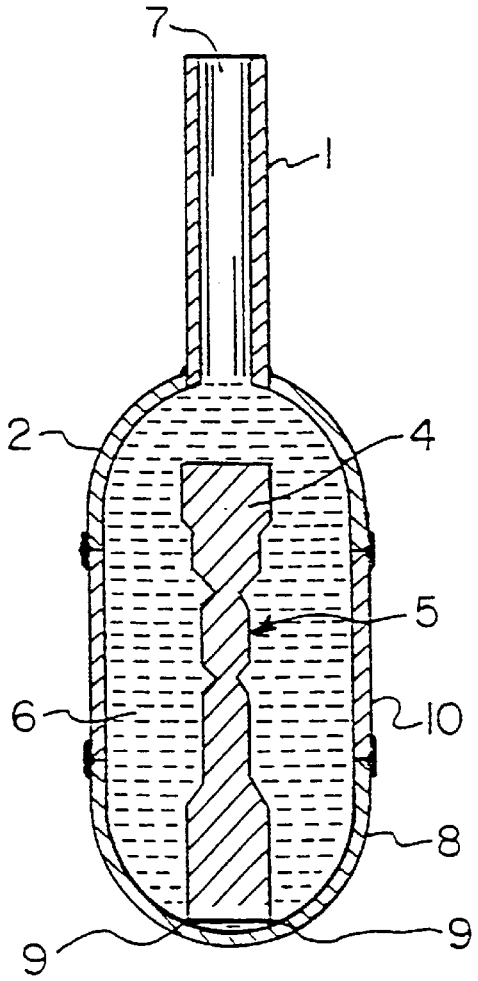
FIG. 1 is a cross section through the centerline of a canister showing the pattern with the space between the pattern and the canister filled with powder according to the present invention.

A method of practicing this invention as shown in FIG. 1 involves the creation of a steel pattern 4 by classical machining techniques. This pattern is the size and shape of the desired cavity to be produced in the finished die. The pattern is affixed to the bottom of the canister 8 by tack welds 9. A coating of yttrium oxide 5 is applied to the surface of the pattern 4. In a separate operation, the fill/evacuation tube 1, top 2 and central portion of the canister 10 are welded together. This assembly is then welded to the bottom segment 8 of the canister.

Powder of the desired die material is then introduced into the canister via the opening 7 in the fill/evacuation tube 1. The powder 6 in this example is M4 tool steel and fills the space between the pattern and the internal surfaces of the canister. The air is evacuated from the canister through the fill/evacuation tube 1 which is then welded closed. The canister containing the pattern and the powder is then hot isostatic pressed at 2175° F. for five hours at a pressure of 15,000 PSI. This process consolidates the powder creating a solid compact around the pattern.

Figure 2:
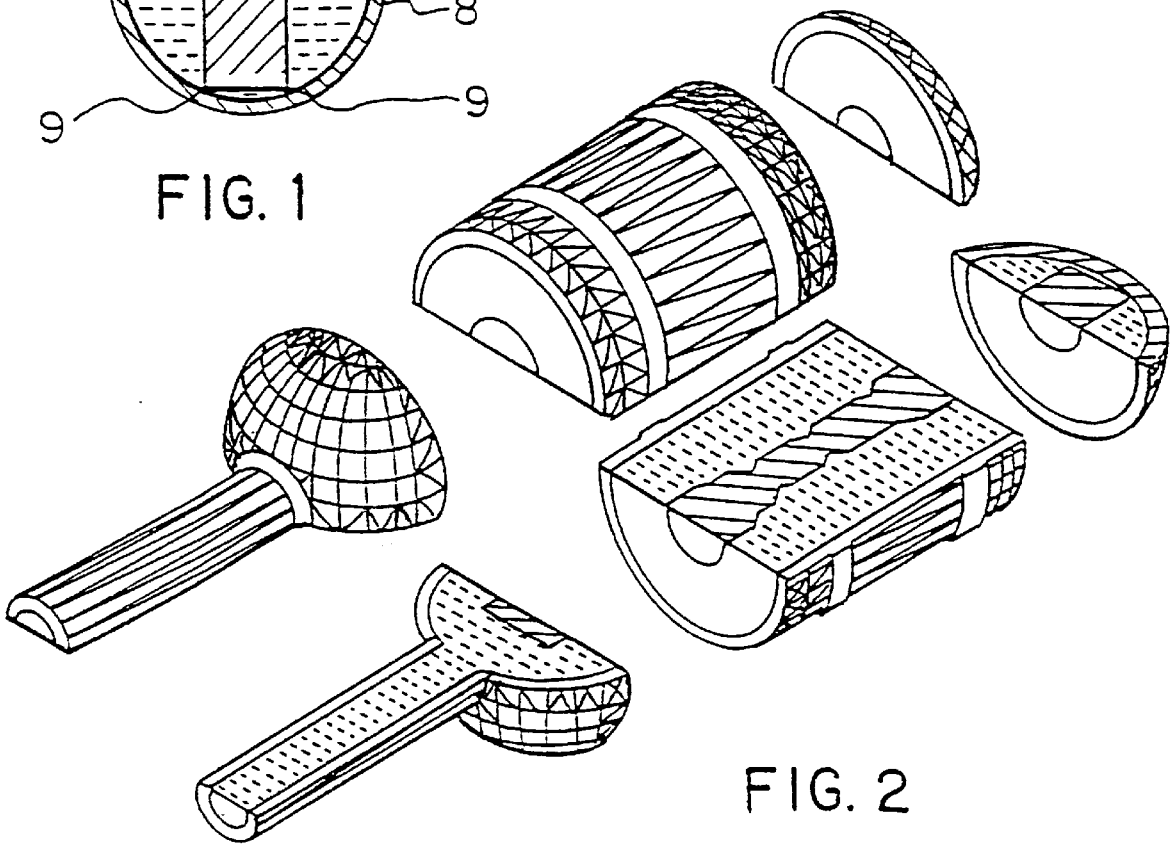
FIG. 2 is a view of the canister of FIG. 1 after hot isostatic pressing showing the sectioning lines.
Figure 3:
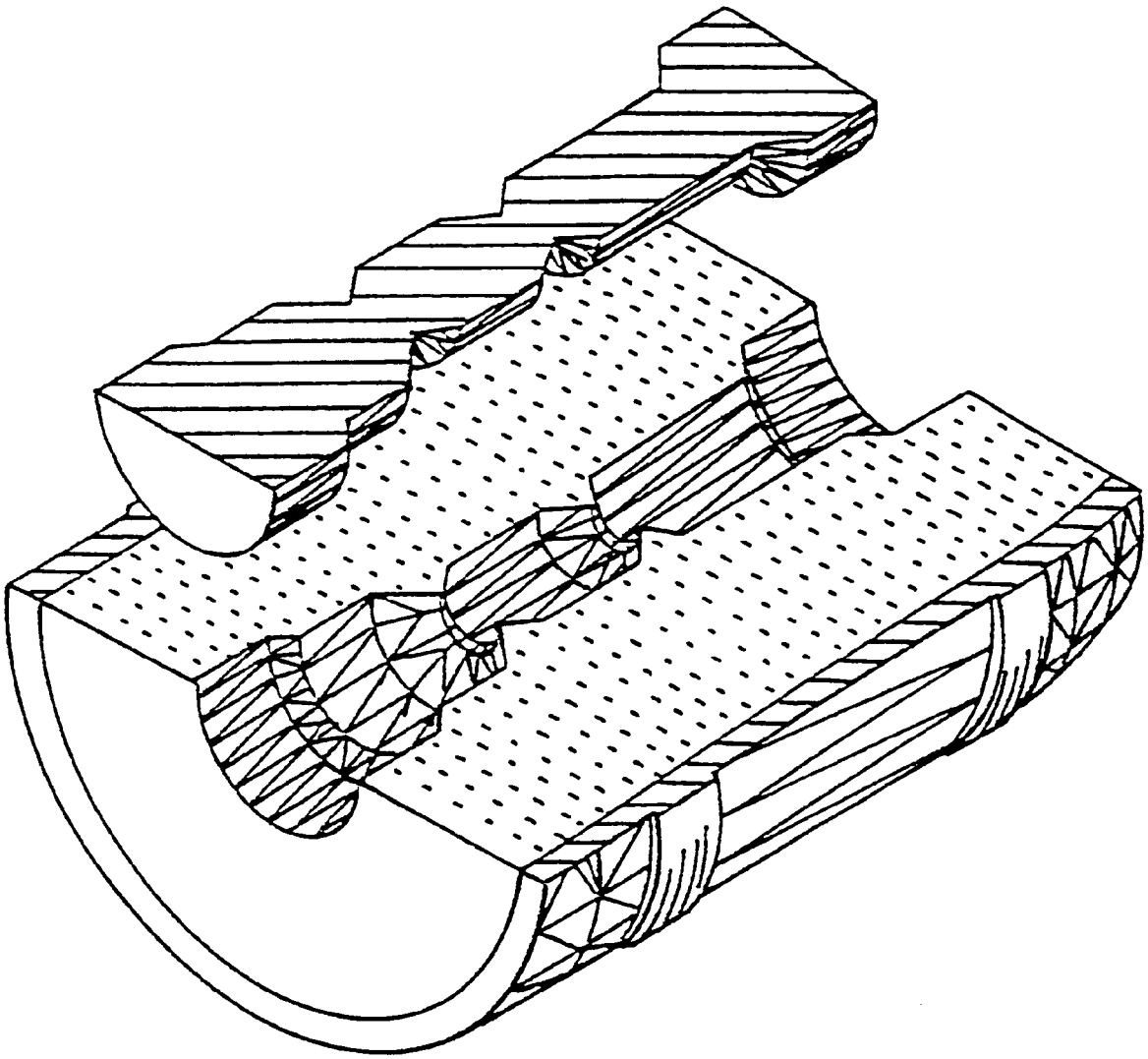
FIG. 3 is a view showing the die with the pattern of FIGS. 1 and 2 removed.

In order to remove the pattern, the consolidated canister is bandsaw cut as shown in FIG. 2. Upon removal of the pattern halves from the compact, the desired die cavity is revealed, see FIG. 3.

Figure 4:
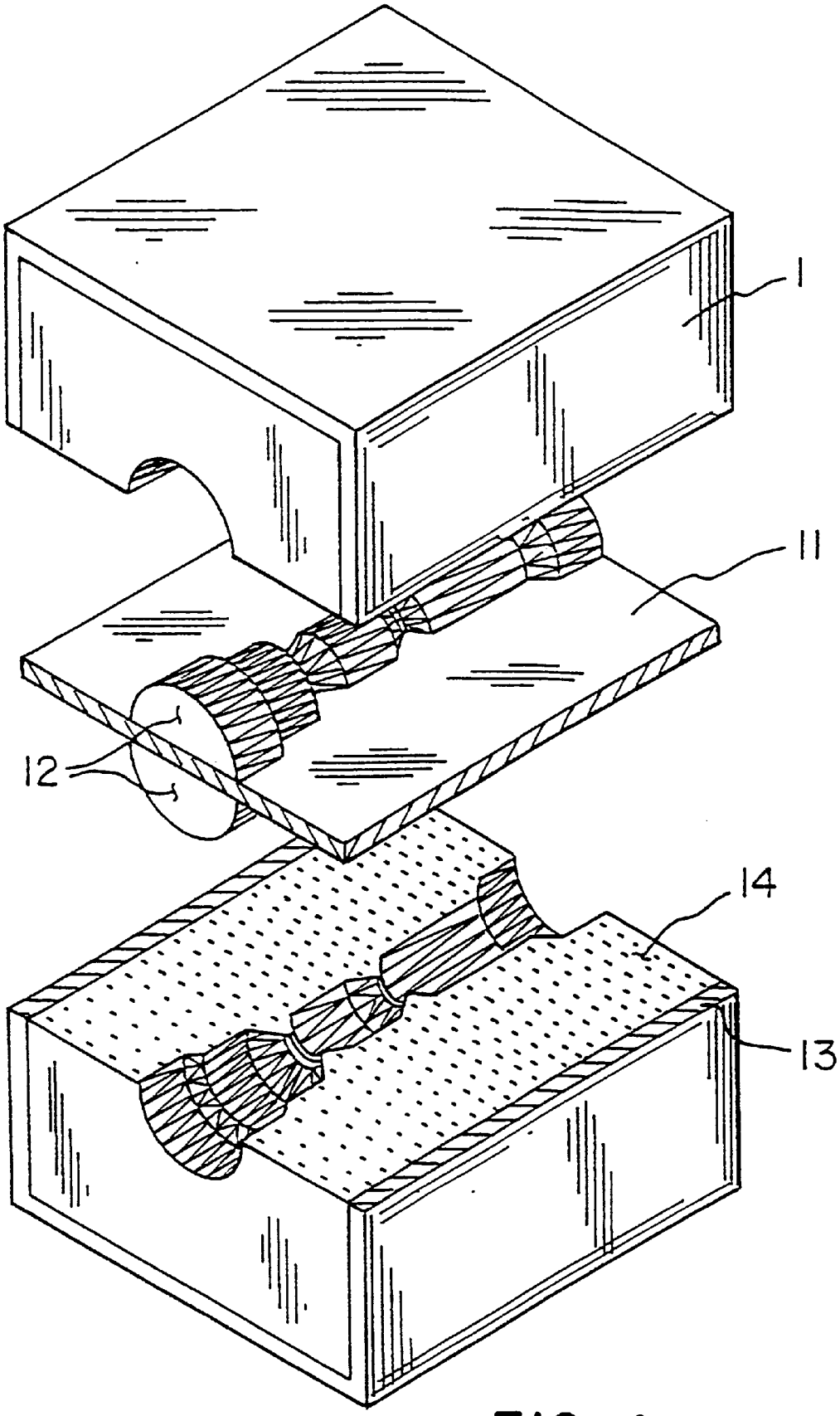
FIG. 4 is a perspective view of a compacted die, after separation, showing the pattern and parting plate used in the method of the present invention.

A presently preferred embodiment of the invention is shown in FIG. 4. In this embodiment, a parting plate 11 is placed between the halves of the pattern 12. The parting plate 11 may be, for example, ½ inch thick carbon steel. The parting plate is either integral with the pattern 12 or may be pinned or tack welded thereto. The pattern is made slightly oversized on each side of the parting plate to accommodate the thickness of the parting plate. The assembled pattern and parting plate are coated with a parting agent such as boron nitride and are then positioned inside the canister 13. Tack welding or mechanical fasteners are used to attach the pattern/parting plate to the inside of the canister. The canister is then welded closed, incorporating a fill tube. In this example, H13 powder is introduced into the canister through the fill tube followed by evacuation and sealing of the canister. Hot isostatic pressing at 2175° for five hours at 15,000 PSI consolidates the powder into a solid.

Removal of the pattern is accomplished by cutting or milling the edges of the canister to expose the edges of the parting plate. The die halves are then separated from the pattern and the parting plate. The pattern assembly may then be used to produce additional dies or molds.

While the above description is the currently preferred approach, there are numerous variations which would be apparent to those of ordinary skill in the art. These include, but are not limited to, changing the powdered material used for the die. Obviously, this selection would be determined by the properties required in the final die or mold. Typical materials generally classified as tool steels, nickel alloys, cobalt alloys and copper alloys could be used. The consolidation parameters would then be selected for the alloy being used.

Also, the technique used to manufacture the patterns may include forging, casting or selected layer sintering. It is also possible to use parts which were previously produced from dies made by the present invention.

Presently, yttrium oxide has been applied to the pattern to act as a release coating to prevent the powder from bonding to the pattern during the consolidation process. Other choices of release agents or diffusion barriers could be equally effective. These may include aluminum oxide, zirconium oxide, silicon dioxide, magnesium oxide, titanium oxide, thorium oxide, titanium carbide, titanium nitride and boron nitride. It would also be possible to create the release layer on the pattern by thermally treating the pattern in an oxidizing or nitriding environment.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A method of making dies and molds comprising the steps of:

providing a pattern having a desired shape to define one of a die or mold cavity;

providing a canister having a hollow interior;

placing the pattern in the hollow interior of the canister;

filling the canister with a powdered metal to surround the pattern therein;

hot isostatic pressing the canister to consolidate and densify the powdered metal; and sectioning the consolidated and densified powdered metal to permit removal of the pattern whereby one of a die or mold cavity is provided.

2. The method of claim 1 including the steps of evacuating air from the canister after the filling step and sealing the canister, as by welding, after said evacuating step and before said hot isostatic pressing step.

3. The method of claim 1 including the step of providing a flat plate around said pattern prior to said placing step, said plate extending outwardly from the pattern to the canister whereby a parting line is created by said plate after said pressing step.

4. The method of claim 1 including the step of coating the pattern with a release agent to prevent the metal powder from bonding to the pattern during the hot isostatic pressing step.

5. The method of claim 4 wherein the release agent is one selected from the group consisting of yttrium oxide, aluminum oxide, zirconium oxide, silicon dioxide, magnesium oxide, titanium oxide, thorium oxide, titanium carbide, titanium nitride and boron nitride.

6. The method of claim 4 wherein the release agent is created by thermally treating the pattern in one of an oxidizing or nitriding atmosphere.

7. The method of claim 1 wherein the hot isostatic pressing step is carried out at a pressure of about 15,000 PSI and at a temperature of about 2175° F. for about five hours.

8. The method of claim 1 wherein the powdered metal is a powdered metal used for die materials comprising one selected from the group consisting of tool steels, nickel alloys, cobalt alloys and copper alloys.

9. A method of making dies and molds comprising the steps of:

providing a pattern of a desired shape to define one of a die or mold cavity;

providing a canister having a hollow interior;

placing the pattern in the hollow interior of the canister and affixing the pattern to the canister;

coating the pattern with a layer of yttrium oxide;

filling the canister with a powdered M4 tool steel to fill the space between the pattern and the internal surfaces of the canister;

evacuating air from the canister;

sealing the evacuated canister by welding;

consolidating and densifying the M4 tool steel powder by hot isostatic pressing the canister and contained powder at a pressure of 15,000 PSI and at a temperature of 2175° F. for a time of five hours; and sectioning the consolidated and densified powdered metal and removing the pattern therefrom to provide one of a die or mold cavity.

10. The method of claim 9 including the step of providing a flat plate around said pattern prior to said placing step, said plate extending outwardly from the pattern to the canister whereby a parting line is created by said plate after said pressing step.

11. A die or mold comprising a die set made by hot isostatic pressing powdered metal and having a die cavity of a desired configuration formed therein during said hot isostatic pressing operation.

12. The die or mold of claim 11 wherein the powdered metal is one selected from the group consisting of tool steel, nickel alloy, cobalt alloy and copper alloy.

13. The die or mold of claim 11 wherein the powdered metal is an M4 tool steel.

* * * * *